US006113669A

United States Patent [19]

Vorobeichik et al.

[11] Patent Number: 6,113,669

[45] Date of Patent: Sep. 5, 2000

[54] METHOD AND APPARATUS FOR PROCESS AND QUALITY CONTROL IN THE PRODUCTION OF METAL

[75] Inventors: Vladimir M. Vorobeichik, Ashdod, Israel; Robert J. Koffron, Farmington Hills, Mich.; Anatoly I. Babushkin, Atlit, Israel; Ross A. Jacobs, Snowmass, Colo.; Ilya V. Vorobeichik, Ilaifa, Israel; Jeffrey D. Jacobs, Farmington Hills, Mich.

[73] Assignee: Seltet LLC, Farmington Hills, Mich.

[21] Appl. No.: 09/241,236

[22] Filed: Feb. 1, 1999

[51] Int. Cl.[7] ..... C22B 9/00

[52] U.S. Cl. ..... 75/577; 266/79

[58] Field of Search ..... 75/577; 266/79

[56] References Cited

U.S. PATENT DOCUMENTS

| | | | |
|---|---|---|---|
| 3,920,447 | 11/1975 | Schroeder et al. . | |
| 4,615,225 | 10/1986 | Sainz . | |
| 5,082,044 | 1/1992 | Christensen | 75/377 |
| 5,278,629 | 1/1994 | Schlager et al. . | |
| 5,526,110 | 6/1996 | Braymen | 356/316 |
| 5,671,045 | 9/1997 | Woskov et al. . | |
| 5,889,587 | 3/1999 | D'Silva et al. | 356/316 |

FOREIGN PATENT DOCUMENTS

| | | |
|---|---|---|
| 58-090150 | 5/1983 | Japan . |
| 58-090151 | 5/1983 | Japan . |
| 58-090152 | 5/1983 | Japan . |

*Primary Examiner*—Melvyn Andrews
*Attorney, Agent, or Firm*—Brook & Kushman P.C.

[57] ABSTRACT

A method and apparatus are provided for rapidly and accurately processing the chemical composition of a molten metal bath within a furnace. The apparatus includes a robotically-controlled probe which operates to obtain a sample from any predetermined depth of the vessel. The probe is moved from the vessel to a thermostabilized atomic emission spectrometer in nearby proximity to the vessel wherein a part of the probe containing the sample is joined with an upper chamber housing to form an excitation chamber. Within the excitation chamber, the optical emission spectrum of the sample is excited by an excitation source. The optical spectrum is transmitted to an analyzer where the elemental concentration of the sample is determined. Immediately responsive to this analysis, adjustments are made in processing to achieve the target grade of steel.

19 Claims, 6 Drawing Sheets

Fig. 2
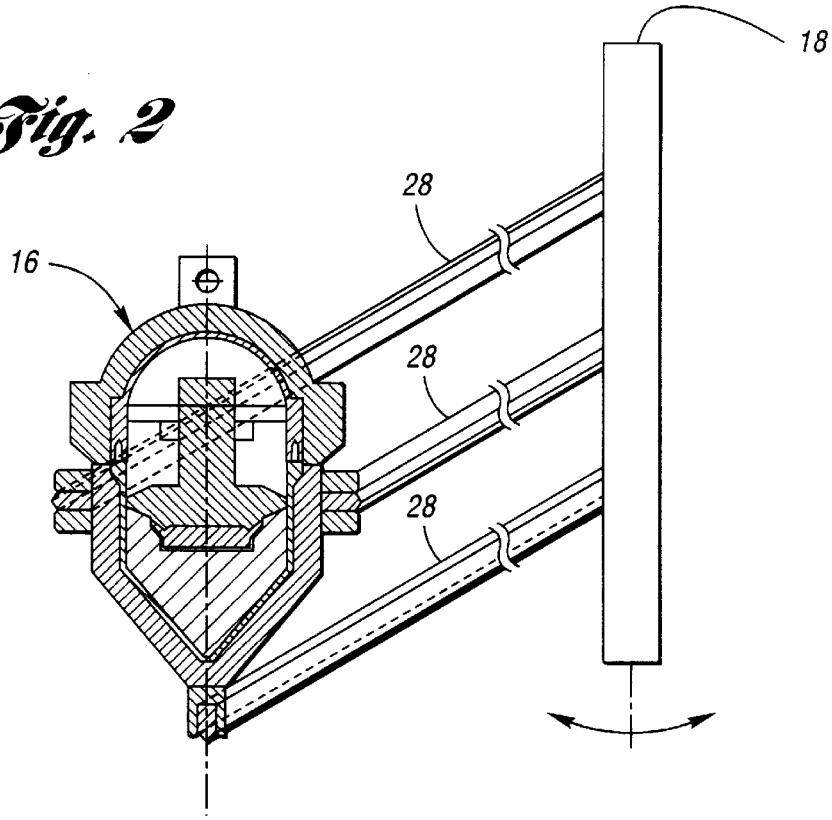
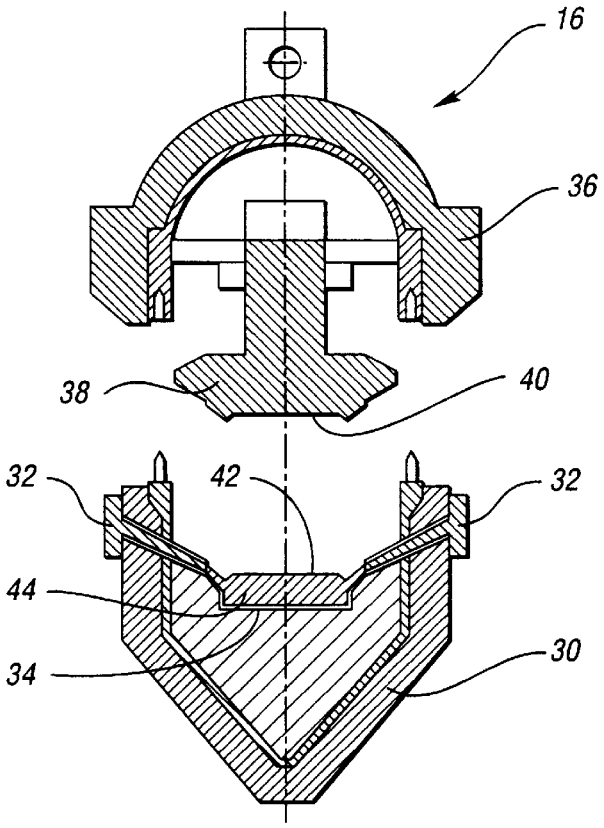
Fig. 3

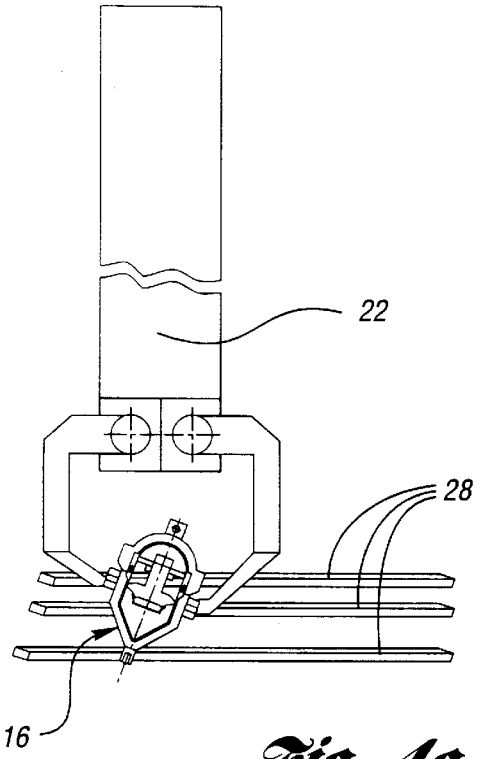
Fig. 4a
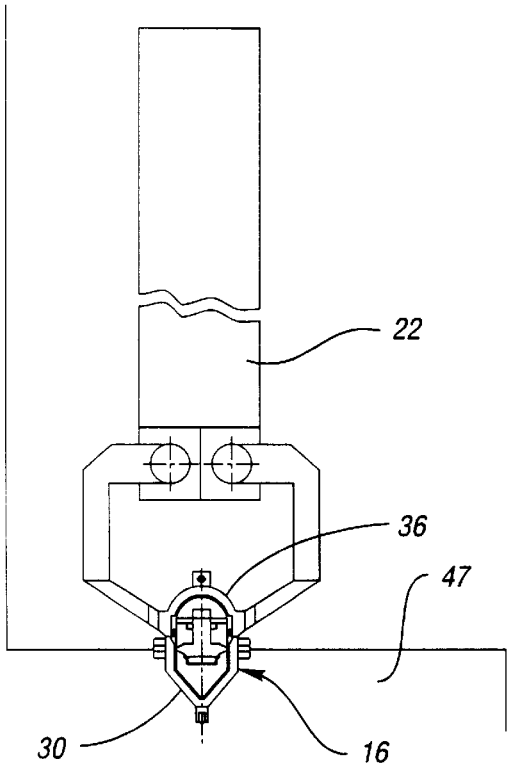
Fig. 4b
Fig. 4c
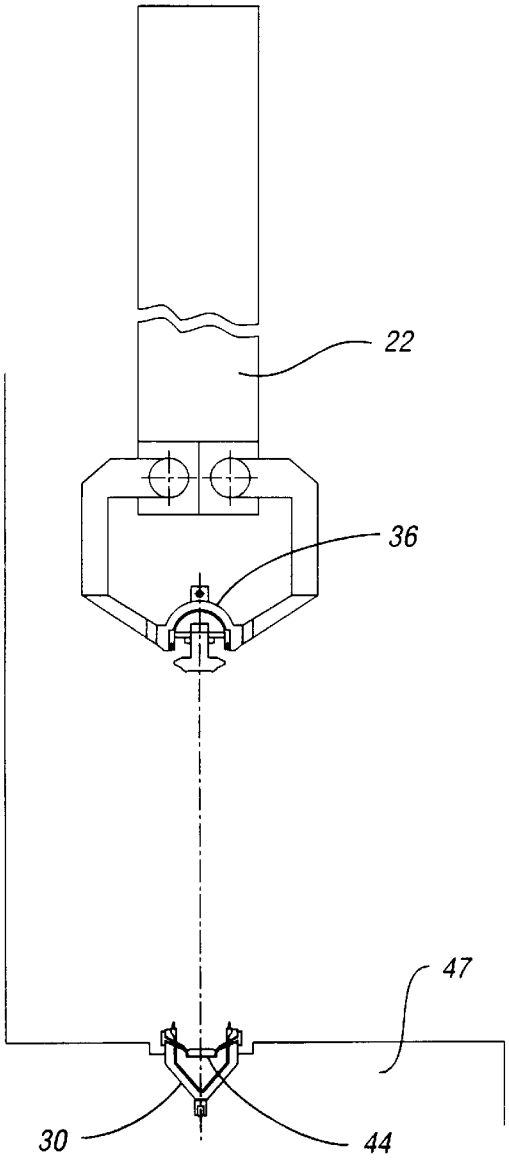

Fig. 5
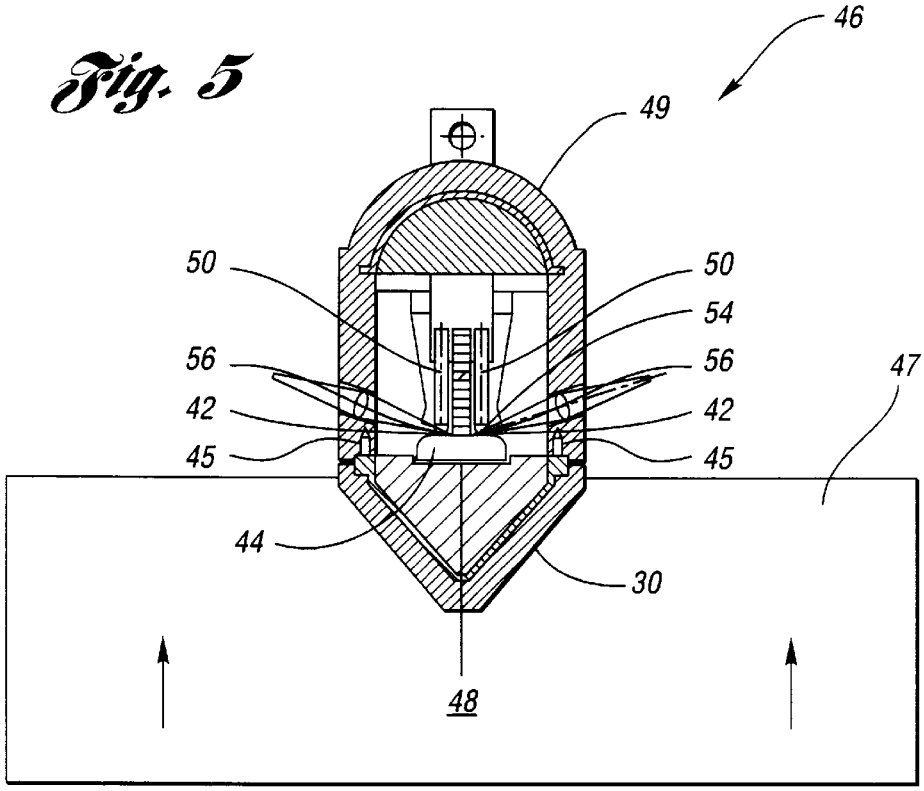
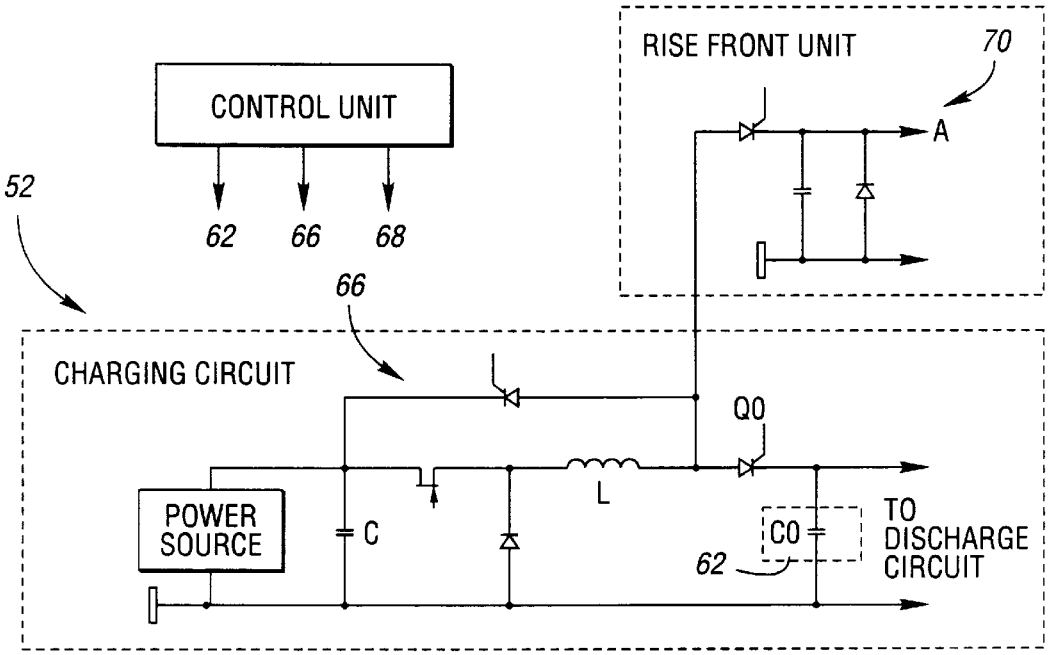
Fig. 6a

METHOD AND APPARATUS FOR PROCESS AND QUALITY CONTROL IN THE PRODUCTION OF METAL

TECHNICAL FIELD

This invention relates to process and quality control in the metallurgical industry, and in particular to a method and apparatus for the direct analysis of molten metal composition during production using atomic emission spectrometry.

BACKGROUND ART

Atomic emission spectroscopy is an analytical method which is used for determining and measuring the chemical composition of materials. According to this method, a material sample is heated and vaporized by a spectral excitation source. Atoms of the sample are excited and partially ionized, causing them to emit light in the ultraviolet, visible, or near infrared spectral region. The radiated light is characterized by an arrangement of spectral lines, and the intensity of these spectral lines indicates the atomic concentration within the sample.

Atomic emission spectroscopy has been used to determine material composition during steel making, since the physical properties of a metal, such as strength, hardness, and corrosion resistance, depend in part on its composition. Improving production efficiency has been difficult because analysis of the chemical composition of molten metal within a furnace has not been rapid and accurate enough to change the production process of the melt being analyzed. Furthermore, the hot, dirty environment of a furnace limits the type of apparatus that can be used in close proximity for sampling and testing to detect the presence of the constituent elements.

There have been several different methods used to determine the composition of molten metal within a furnace. Certain prior art devices pump molten metal to a remote analytical laboratory. This configuration obviates the need for environmentally protecting the sophisticated optical instrumentation, but results in very long analysis times and high construction costs. Other devices obtain samples from near the melt surface, where the slag layer can interfere with the analysis. Yet other devices utilize a probe inserted into the melt to excite a small portion of the molten metal while still in the furnace. While such a method avoids costs associated with sampling, high development and materials costs are required to position and operate optical instrumentation within the probe in such an extreme temperature environment.

DISCLOSURE OF THE INVENTION

The present invention overcomes the above-mentioned disadvantages by providing a method and apparatus for processing metal, such as during production, which provides a spectral determination of the chemical composition of metal in the high temperature environment proximate the furnace, that improves the accuracy and reduces the time for elemental analysis so that adjustments can be made during production at a low cost.

The present invention utilizes a probe capable of obtaining a sample of molten metal from any predetermined depth of a vessel and depositing the sample in a nearby analyzer. The time required for the analysis is reduced through the use of a robotic system to move the probe and a method by which a part of the probe containing the sample is deposited directly into a thermostabilized atomic emission spectrometer proximate the furnace. Within the atomic emission spectrometer, the deposited probe part is joined with an upper chamber housing to form an excitation chamber. Within the excitation chamber, the optical emission spectrum of the sample is excited by an excitation source. The optical spectrum is transmitted to an analyzer where the elemental concentration of the sample is determined. Immediately responsive to this analysis, adjustments are made in processing to achieve the target grade of steel. As a result of these features, alterations in the composition of the melt may be enacted more efficiently and accurately during processing, thereby shortening the overall melting duration and allowing expensive alloys to be produced more economically.

The above features and other features and advantages of the present invention are more readily understood from a review of the attached drawings and the accompanying specification and claims.

BRIEF DESCRIPTION OF THE DRAWINGS

FIG. 2 is a sectional view of a probe utilized in the apparatus of FIG. 1 and its connection to a probe holder and linear traversing unit of the present invention;

FIG. 3 is a sectional view of the separation of the probe of the present invention;

FIGS. 4*a*, 4*b*, and 4*c* are sectional views of the removal of the probe from the probe holder, engagement of the probe with an excitation chamber, and deposition of a lower part of the probe in the excitation chamber, respectively;

FIG. 5 is a sectional view of the excitation chamber shown in FIG. 4 in accordance with the present invention;

FIGS. 6*a* and 6*b* are the schematic diagrams of preferred charge and discharge circuits, respectively, of a spectral excitation source for use in the present invention;

BEST MODES FOR CARRYING OUT THE INVENTION

Figure 1:
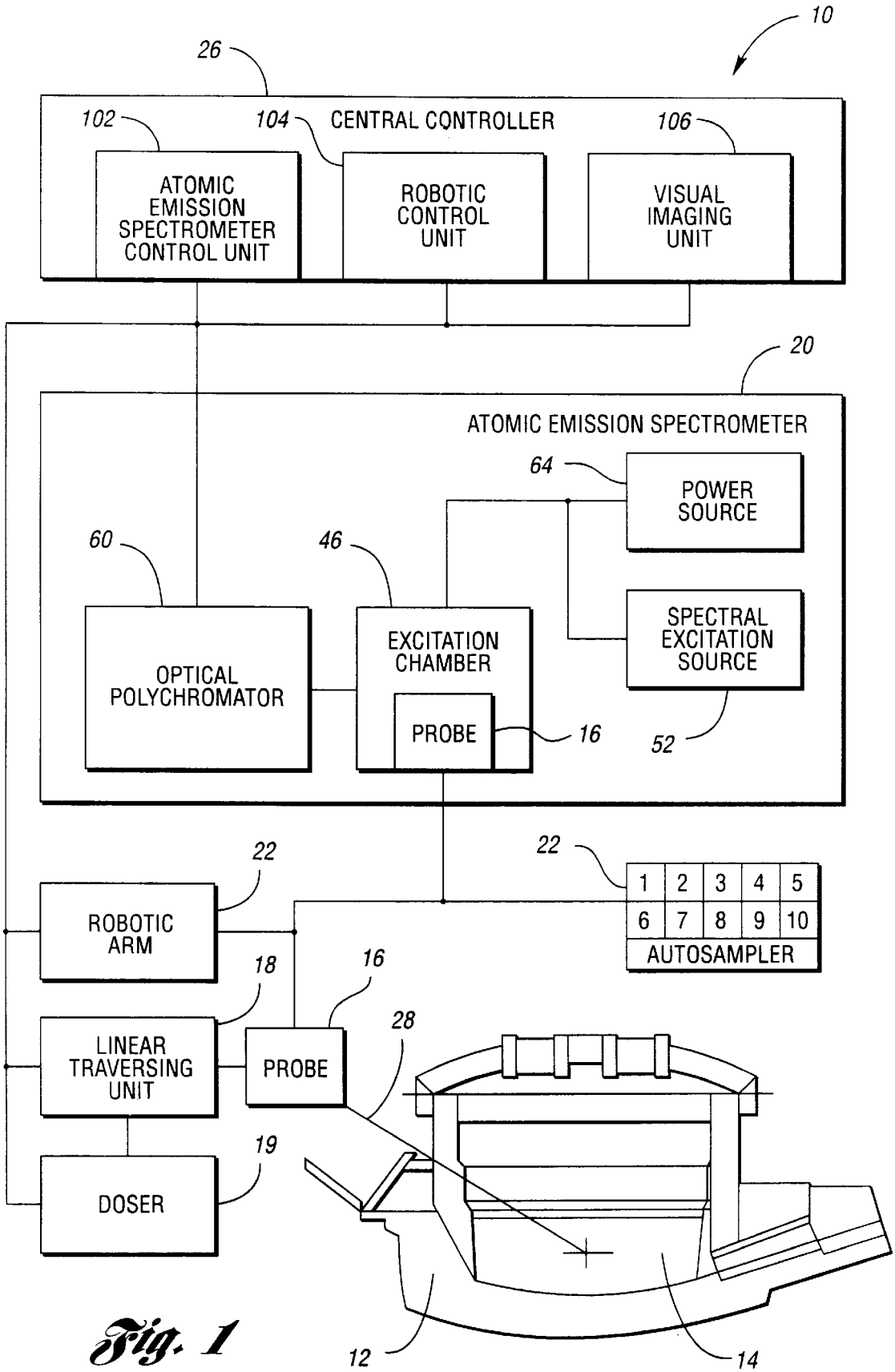
FIG. 1 is a schematic drawing of a metal processing apparatus constructed in accordance with the present invention.

Referring first to FIG. 1, a metal processing apparatus 10 in accordance with the present invention includes a furnace 12 containing a bath 14 of molten metal. Metal processing apparatus 10 generally includes a probe 16 for obtaining a sample of molten metal from within bath 14, a linear traversing unit 18 for positioning probe 16 within bath 14, a doser 19 for adding elements to bath 14, an atomic emission spectrometer 20 for analyzing the sample obtained from bath 14, a robotic arm 22 for transferring probe 16 from bath 14 to atomic emission spectrometer 20, an autosampler 24 containing a plurality of probes 16, and a central controller 26 which governs all actions associated with apparatus 10. Atomic emission spectrometer 20 and its components are thermostabilized, such as with a refractory material, so that they may function in close proximity to furnace 12.

Probe 16 is preferably disposable and constructed of a non-corrosive, high melting-point metal, such as tungsten, or a refractory material, such as fire-clay. For insertion into bath 14, robotic arm 22 fastens a probe 16 from autosampler 24 to a three-pronged probe holder 28, as shown in FIG. 2. Probe holder 28, which is preferably composed of graphite, is connected to linear traversing unit 18 for submersion into bath 14. In compliance with the melting schedule or at an operator's request, furnace 12 is opened, linear traversing unit 18 is rotated and angled toward furnace 12, and probe holder 28 and attached probe 16 are sunk into bath 14. Probe 16 is inserted through the top layer of slag, and is selectively located at a desired depth and position within bath 14 by linear traversing unit 18. After positioning, linear traversing unit 18 performs several smooth horizontal motions for quality filling of probe 16 with molten metal.

In a preferred embodiment, probe 16 is constructed from two hermetically sealed parts, as depicted in FIG. 3. The lower probe part 30 is provided with inlets 32 to allow the inflow of molten metal. Inlets 32 are initially closed by a temperature-destructive material, such as cork. With a quick passage of probe 16 across the slag, inlets 32 remain closed such that slag material is not sampled. After probe 16 has passed across the slag, the corks disintegrate and molten metal is allowed to enter probe 16 and fill a trough 34 provided therein. The upper probe part 36 is preferably formed with an insert 38 having a planar surface 40 for forming a planar surface 42 on the sample 44.

As shown in FIG. 4, after removal from bath 14, probe 16 is controlled by robotic arm 22 in order to separate probe 16 from probe holder 28 (FIG. 4*a*), deposit lower probe part 30 into table 47 (FIG. 4*b*) within atomic emission spectrometer 20, and then separate upper probe part 36 from lower probe part 30 to expose sample 44 (FIG. 4*c*). Since sample 44 is solid or liquid in form, the elements of interest for spectral analysis are bonded to other elements. In order to utilize atomic spectrometry, the individual bonds must be broken and sample 44 converted to a gaseous, or plasma, state.

Referring now to FIG. 5, table 47 is operable to move upward so that lower probe part 30 engages an upper chamber housing 49 via connection pins 45 to enclose sample 44 and form an excitation chamber 46. A scan driver 48 actuated by a stepper motor (not shown) is used for precise placement of the planar surface 42 of sample 44 on the optical axis of excitation chamber 46. Upper chamber housing 49 of excitation chamber 46 is provided with several high voltage rod electrodes 50 which are operably connected to a spectral excitation source 52 (shown schematically in FIG. 6). Spectral excitation source 52 applies a high voltage between electrodes 50, which generates electrical discharges between planar sample surface 42 and electrodes 50, forming analytical gaps 54 therebetween.

During a preliminary heating cycle, spots at sample surface 42 are heated to provide more homogeneous evaporation of sample 44, as is well known in the art. The temperature of the spots is controlled by the discharge power of spectral excitation source 52. The spots are blown by an inert gas, such as argon, which is delivered from a pressurized gas source (not shown) into excitation chamber 46. As is well known in the art, the inert gas is used to provide more stable measurements, eliminate possible oxidation of sample surface 42, and provide spectral transmission in the ultraviolet range.

The discharge between electrodes 50 and sample surface 42 erodes small particles from sample 44 which are excited by spectral excitation source 52. In response, sample 44 emits radiation 56 in accordance with the elements in the sample 44. The characteristic frequencies of emitted radiation 56, the emission spectrum, identify the constituent elements, and the intensities of the radiation indicate the quantities thereof. A fiber optic cable 58 or optical lens is exposed to the emitted radiation 56, and establishes an output signal containing the several wavelengths of the elements in the solution which is transmitted from analytical gaps 54 to an optical detector, preferably a multichannel polychromator 60 (best shown in FIG. 7).

Figure 6B:
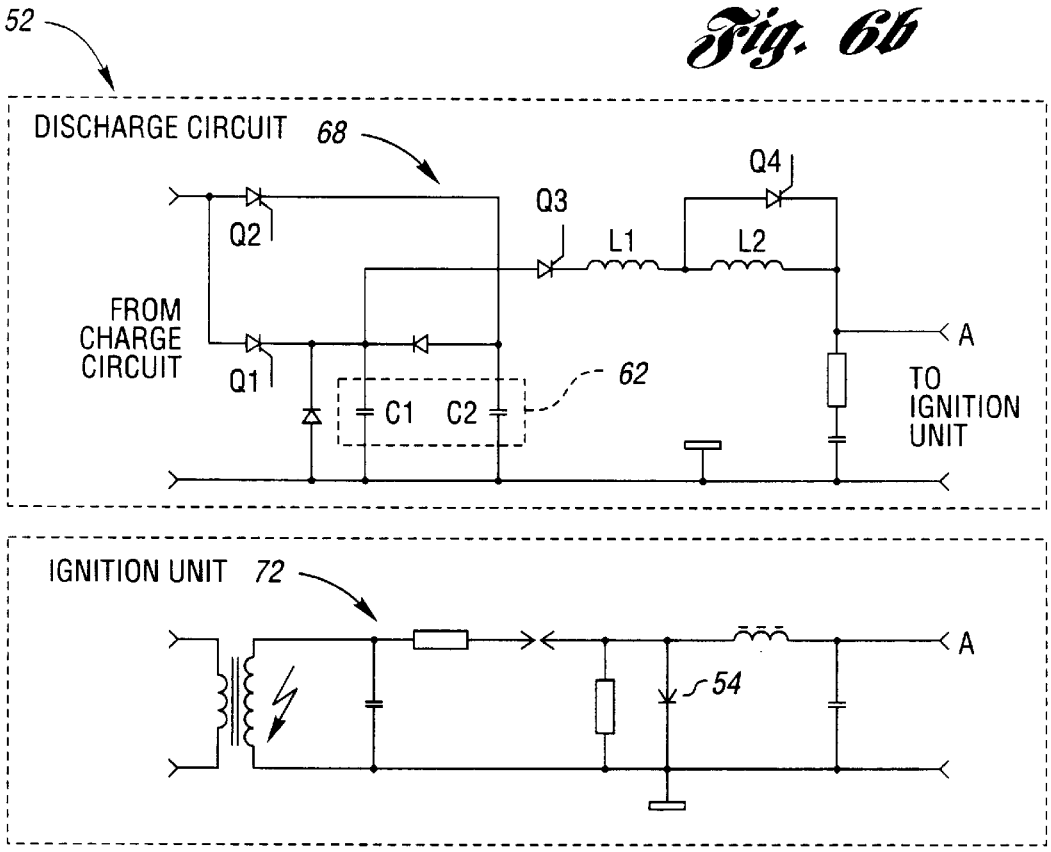

As is well known in the art, a spark generator provides high voltage sparks as the electrical discharge, while an arc generator provides an alternating current discharge. As depicted in FIGS. 6*a* and 6*b*, spectral excitation source 52 preferably provides a CLV discharge, meaning that capacitors, inductances, and nonlinear elements such as diodes are involved in the formation of the current impulse. A capacitor unit 62 is charged from a power source 64 through a special charge circuit 66 (FIG. 6*a*) and discharged through a discharge circuit 68 and analytical gaps 54 (FIG. 6*b*). Charge circuit 66 also provides power for a rise front unit 70 (FIG. 6*a*), and an ignition unit 72 (FIG. 6*b*) which are connected with analytical gaps 54 and contain capacitors for energy storing. A control unit 74 controls parameters of capacitor unit 62, charge circuit 66, and discharge circuit 68.

Each discharge cycle is generated in two stages. In the first stage, capacitor unit 62, rise front unit 70, and ignition unit 72 are charged from charge circuit 66 to a predetermined voltage level as controlled by control unit 74. When a predefined level is reached, the charge current is interrupted. Electromagnetic energy that is stored in inductance L of charge circuit 66 in the moment of current interruption returns to capacitor C associated with power source 64.

A special feature of the present invention is that resistive elements are not used in charge circuit 66, but only inductances and switches. This increases the effectiveness of spectral excitation source 52, prevents heat dissipation, and allows spectral excitation source 52 to be placed in close proximity to sensitive optical instruments. Current switching in charge circuit 66 and discharge circuit 68 is performed by power electronic switches, such as thyristors $Q_0$, $Q_1$, and $Q_2$, according to commands from control unit 74 which compare the voltage on capacitors $C_0$, $C_1$, and $C_2$ within capacitor unit 62 with a reference level. The total number of charged capacitors as well as the voltage level in capacitor unit 62 is defined by control unit 74 and may change from pulse to pulse.

After charging to determine the voltage, capacitors $C_0$, $C_1$, and $C_2$ are disconnected from power source 64. In the second stage, capacitor unit 62 discharges through discharge circuit thyristors $Q_3$ and $Q_4$, inductances $L_1$, and $L_2$, and analytical gaps 54. As a rule, the voltage of the capacitors within capacitor unit 62 is not high enough to perform an electrical breakdown of analytical gaps 54. Therefore, ignition unit 72 is used for stable, reproducible breakdown of analytical gaps 54 using a high voltage (~10 kV) and very small power spark.

Parameters of discharge circuit 68 are under control of control unit 74 and may be changed remotely rather than requiring operator access to atomic emission spectrometer 20. Depending on the parameters of discharge circuit 68 and the total capacitance of capacitor unit 62, it is possible to get different types of discharge pulses. The discharge may be an arc-type discharge (relatively small current and long pulse duration) or a spark-type discharge (relatively large current and small pulse duration). Each discharge type has its benefits, and rise front unit 70 is used with the purpose of producing a combined discharge type which integrates the beneficial features of both types.

At the start of the discharge process, rise front unit 70 generates a spark-type discharge in the shape of a sharp unipolar current peak (~50–100 A/20–50 μsec) which excites the spectral lines of ions. Discharge circuit 68 generates the main part of the discharge current pulse, which is an arc-type discharge formed in the shape of an aperiodic current impulse (~20–100 A/250–400 μsec) which excites the spectral lines of neutral atoms. The pulse energy and wave form are defined by capacitances, inductances, and the voltage level. These parameters as well as the frequency and duration of the pulse are all controlled by control unit 74. Spectral excitation source 52 generates a repetitive sequence of discharge pulses, and the whole charge/discharge process is repeated with computer-controlled frequency.

Figure 7:
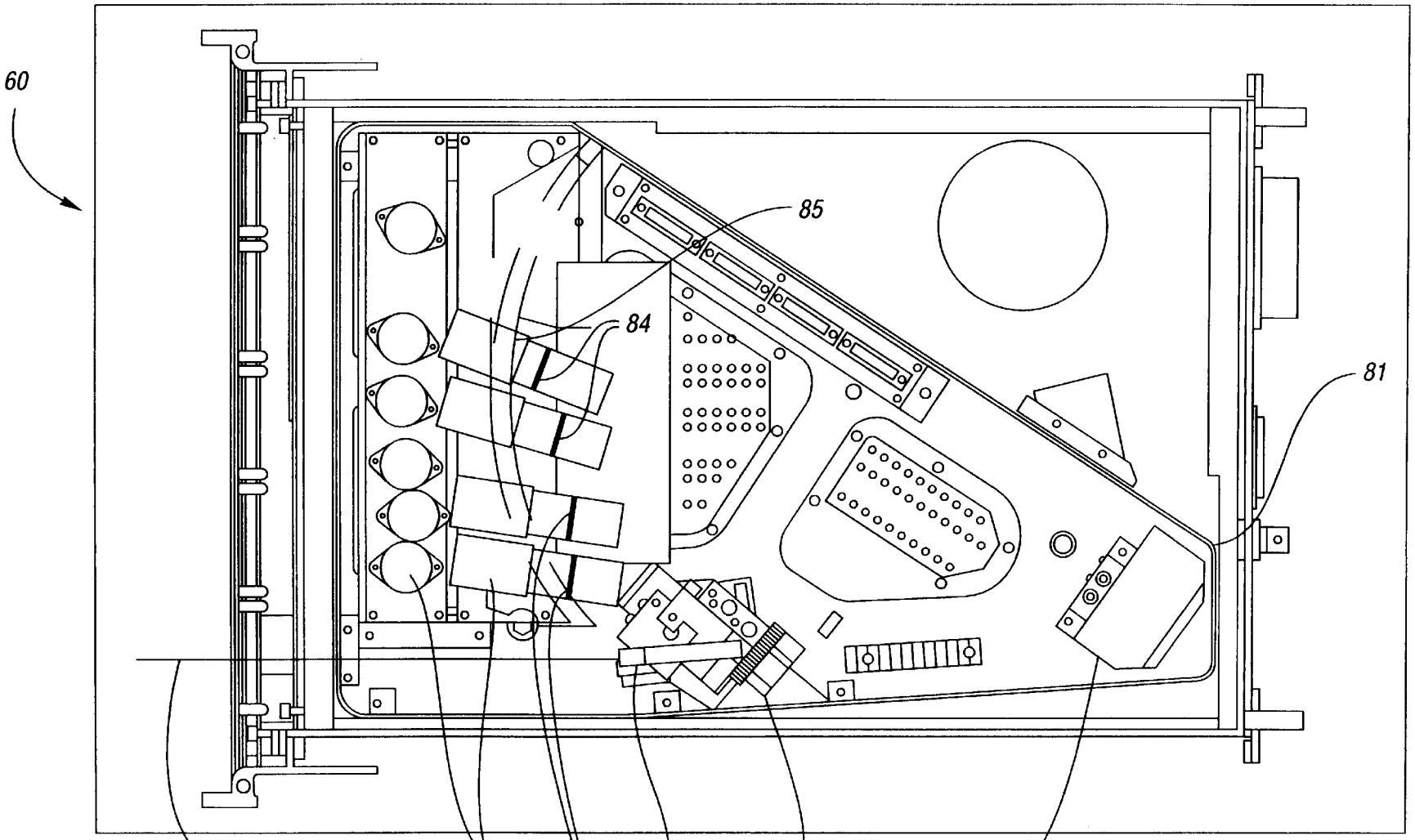
FIG. 7 shows a multichannel polychromator in accordance with the present invention.

Referring next to FIG. 7, shown is multichannel polychromator 60, which provides optical dispersion of the radiation 56 that sample 44 emits and separation of the individual spectral lines. In the preferred embodiment, the classical Pashen-Runge scheme is utilized for polychromator 60. In this scheme, light enters polychromator 60 through fiber optic cable 58 and an entrance slit 80, the various spectral frequencies are dispersed by a concave, reflection-type diffraction grating 82 and then directed according to wavelength into exit slits 84 which cut spectral lines of required wavelength. Entrance slit 80, exit slits 84, and the center of diffraction grating 82 are situated on the Rowland circle. Preferably, diffraction grating 82 is characterized by 3600 grooves/mm and a curve radius of 498.1 mm. Polychromator 60 consists of an optical bench 81, an illuminating system (not shown), and a mechanism for entrance slit scanning 83.

Entrance slit 80 is installed with a micrometric screw which allows entrance slit 80 to be moved tangentially to the Rowland circle by a computer-controlled stepper motor (not shown) for very accurate spectral line profiling. Exit slits 84 are placed at exact locations along the focal curve 85 to allow passage of light of those specific wavelengths for the elements which are to be measured. Due to certain factors, such as climatic changes or the plastic deformation of optical bench 81, the spectrum position on the Rowland circle may vary with time. The scanning mechanism 83 of fiber optic cable 58 and entrance slit 80 is intended for the compensation of the spectrum shift. The second function of scanning mechanism 83 is to check if exit slit 84 is installed correctly. Scanning should be directed tangentially to the Rowland circle at the point of entrance slit 80.

Figure 8:
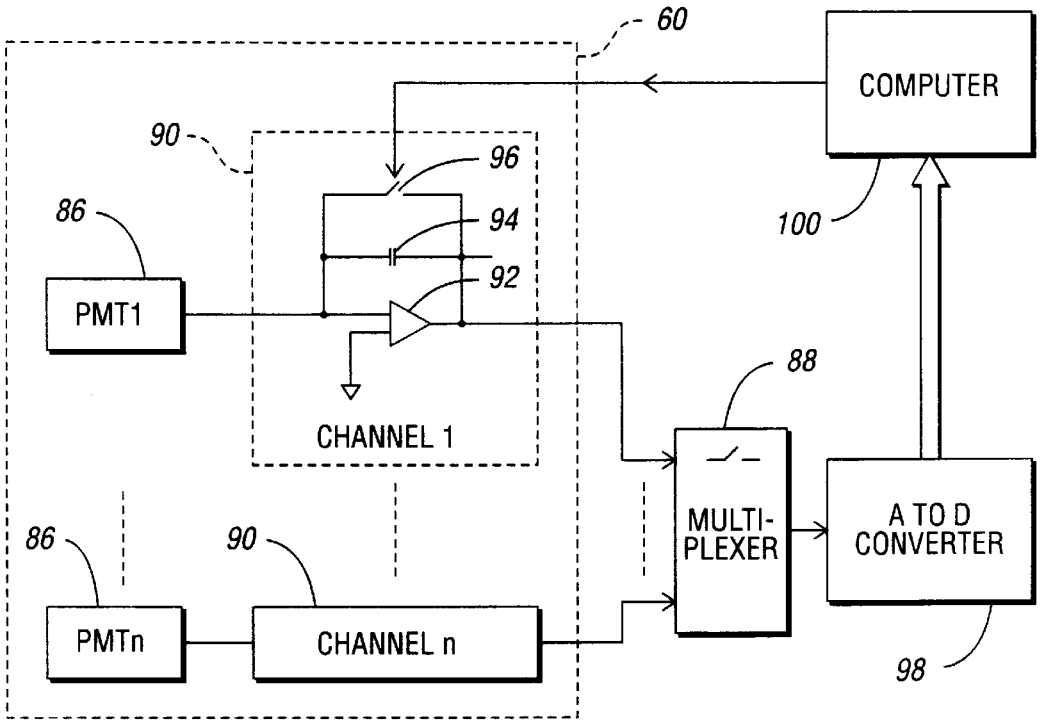
FIG. 8 is a schematic diagram of preferred signal measurement instrumentation in accordance with the present invention.

Multichannel polychromator 60 can simultaneously detect up to 15 individual wavelengths, with the option of up to 24. The separated frequencies of radiation pass through exit slits 84, and light sensors, such as photomultiplier tubes 86, are precisely positioned behind exit slits 84 to measure light passing therethrough. Photomultiplier tubes 86 detect the light emission and generate proportional electrical signals, in particular, current. Photomultiplier tubes 86 within polychromator 60 amplify the various signals produced by the incoming spectra, and the amplified output signals are connected to the input of an analog multiplexor 88 as shown in FIG. 8.

Specifically, each channel 90 within polychromator 60 consists of an active integrator in the form of an operational amplifier 92 with a capacitor 94 in feedback, along with a switch 96 in parallel with capacitor 94. When switch 96 is open, the input current is integrated and the results are stored in capacitor 94. When switch 96 is closed, capacitor 94 is discharged and the channel 90 is reset. The output of multiplexor 88 is connected to an A/D converter 98 which, in turn, transmits data to a computer 100 for storage in memory. Computer 100 also controls the position of switch 96.

At the beginning of a working cycle, controlling information is loaded from central controller 26 to an atomic emission spectrometer control unit 102 and a robotic control unit 104 (best shown in FIG. 1). This information defines all parameters of each discharge pulse and all parameters of robotic motions. Next, charge circuit 66 of spectral excitation source 52 charges capacitor unit 62 and all channels 90 are reset. Then, spectral excitation source 52 initiates the discharge. Switches 96 are opened and integration of the input current from photomultiplier tubes 86 begins. Under computer control, each channel 90 is opened for signal storage at a predetermined moment after the beginning of the light impulse. Signals can be stored during the charging of capacitors within spectral excitation source 52. Multiplexor 88 and A/D convertor 98, under the control of central controller 26, read channels 90 and transmit data to computer 100. The signals are processed by computer 100 to provide a readout of the constituent elements in the melt and the quantities thereof.

Since some elements are vaporized in the earlier stages of discharge and others in the later stages, discharge pulses with different parameters may be included in the sequence of pulses, with each type of discharge optimized for special elements. In addition, different spectral lines may be detected by adjusting the time delay in measurement through different channels 90, thereby achieving the maximum signal to noise ratio. Switches 96 are opened with predetermined time delays relative to the beginning of discharge, wherein the time delay may be programmed for each channel 90 separately to achieve optimal conditions for spectral line emission, either ions or neutral atoms.

The radiation intensity in each channel 90 is measured, and these intensities are compared with standard values to determine the concentration of elements in the sample. The elemental concentration of sample 44 is determined and compared with standard limit values of concentrations for types of metals or alloys. The range for each critical concentration in sample 44 is determined from the appropriate metal standard, wherein each metal or alloy has its own criteria of concentration of elements. Central controller 26 (FIG. 1) analyzes the difference between previous, current, and target concentrations of elements and provides instructions for the control of melting and for adjusting the composition of bath 14 via doser 19 during processing. A visual imaging system 106 (FIG. 1) allows for the observation of all aspects of metal processing with apparatus 10.

It is understood, of course, that while the form of the invention herein shown and described constitutes a preferred embodiment of the invention, it is not intended to illustrate all possible forms thereof. It will also be understood that the words used are words of description rather than limitation, and that various changes may be made without departing from the spirit and scope of the invention disclosed.

What is claimed is:

1. A method for processing the chemical composition of a molten metal bath within a metallurgical vessel, the method comprising:

obtaining a sample of molten metal from the bath using a probe;

transferring the sample to an atomic emission spectrometer in close proximity to the vessel by depositing a part of the probe containing the sample into the atomic emission spectrometer;

exciting the optical atomic emission spectrum of the sample; and analyzing the optical atomic emission spectrum to determine the elemental concentration of the sample.

2. The method of claim 1, wherein obtaining the sample is accomplished using a robotic arm.

3. The method of claim 1, wherein transferring the sample is accomplished using a robotic arm.

4. The method of claim 1, wherein obtaining the sample includes making several horizontal motions with the probe in the bath.

5. The method of claim 1, further comprising joining the deposited part of the probe with an upper chamber housing to form an excitation chamber within the atomic emission spectrometer.

6. The method of claim 1, wherein exciting the optical emission spectrum of the sample includes generating a discharge pulse comprising a first part which excites the spectral lines of ions and a second part which excites the spectral lines of neural atoms.

7. The method of claim 1, wherein exciting the optical emission spectrum of the sample includes generating discharge pulses with different parameters included within a sequence of discharge pulses.

8. The method of claim 1, further comprising adjusting the composition of the bath during processing based on the determined elemental concentration of the sample.

9. An apparatus for processing the chemical composition of a molten metal bath within a metallurgical vessel, the apparatus comprising:

a probe for obtaining a sample of molten metal from the bath, the probe having a first probe part and a second probe part, wherein the first probe part is divisible from the second probe part and the first probe part contains the sample;

an atomic emission spectrometer located in close proximity to the vessel;

an excitation chamber formed within the atomic emission spectrometer by joining the first probe part with an upper chamber housing;

a spectral excitation source operably connected to the excitation chamber, the spectral excitation source operating to excite atoms within the sample to emit optical radiation;

an optical detector operably connected to the excitation chamber to detect and measure the optical radiation and convert the radiation into proportional electrical signals; and a processor operably connected to the optical detector, the processor receiving the electrical signals and determining the elemental concentration of the sample.

10. The apparatus of claim 9, wherein the probe is disposable.

11. The apparatus of claim 9, wherein the first probe part has inlets which are initially closed by a temperature-destructive material, and then selectively open to introduce molten metal into the probe after passage of the probe across a slag layer to any predetermined depth of the bath.

12. The apparatus of claim 11, wherein the temperature-destructive material includes cork.

13. The apparatus of claim 9, wherein the second probe part includes a cover with a planar surface for forming a planar surface on the sample.

14. The apparatus of claim 9, further comprising a robotic arm for controlling movement of the probe.

15. The apparatus of claim 14, wherein the robotic arm performs several smooth horizontal motions within the bath to obtain the sample.

16. The apparatus of claim 14, wherein the robotic arm cooperates with a doser to add elements to the bath to adjust the elemental concentration of the bath based on the determined elemental concentration of the sample.

17. The apparatus of claim 9, further comprising a table into which the first probe part is deposited, wherein the table is operable to join the first probe part and the upper chamber housing to form the excitation chamber.

18. The apparatus of claim 9, wherein the spectral excitation source generates a discharge pulse comprising a first part which excites the spectral lines of ions; and a second part which excites the spectral lines of neutral atoms.

19. The apparatus of claim 9, wherein the spectral excitation source generates discharge pulses with different parameters within a sequence of discharge pulses.

* * * * *